US008882686B2

(12) United States Patent
Chen

(10) Patent No.: US 8,882,686 B2
(45) Date of Patent: Nov. 11, 2014

(54) MOVABLE MASSAGE DEVICE

(75) Inventor: Jui Yao Chen, Changhua County (TW)

(73) Assignee: Listore International Co., Ltd., Dali (TW)

( * ) Notice: Subject to any disclaimer, the term of this patent is extended or adjusted under 35 U.S.C. 154(b) by 579 days.

(21) Appl. No.: 13/277,349

(22) Filed: Oct. 20, 2011

(65) Prior Publication Data

US 2013/0102938 A1 Apr. 25, 2013

(51) Int. Cl.
*A61H 7/00* (2006.01)

(52) U.S. Cl.
CPC ..... *A61H 7/004* (2013.01); *A61H 2201/1215* (2013.01); *A61H 2201/1671* (2013.01); *A61H 2201/1669* (2013.01); *A61H 2201/0138* (2013.01)
USPC ..... 601/97; 601/84; 601/98; 601/101; 601/103; 601/112

(58) Field of Classification Search
USPC ..... 601/23, 24, 27, 29, 33, 34, 35, 84, 85, 601/868, 87, 89, 90, 94, 95, 97, 10, 103, 601/107, 108, 110, 111, 112, 134, 135, 136, 601/101; 606/204
See application file for complete search history.

(56) References Cited

U.S. PATENT DOCUMENTS

| | | | | |
|---|---|---|---|---|
| 7,060,042 | B2 * | 6/2006 | Huang | 601/86 |
| 8,105,253 | B2 * | 1/2012 | Chen | 601/134 |
| 2007/0299379 | A1 * | 12/2007 | Luo | 601/112 |
| 2010/0179460 | A1 * | 7/2010 | Tsai | 601/134 |
| 2010/0286577 | A1 * | 11/2010 | Tsai | 601/112 |

* cited by examiner

*Primary Examiner* — Quang D Thanh
(74) *Attorney, Agent, or Firm* — Alan Kamrath; Kamrath IP Lawfirm, P.A.

(57) ABSTRACT

A movable massage device is capable of overcoming the fixed-point type massage device and is provided with an outer housing, a toothed bar, an inner housing, a driven assembly, a drive assembly, a first massage head and a second massage head. With the cooperation of the driven and drive assemblies, the inner housing is able to drive the first and second massage heads to reciprocate transversely within the outer housing, to perform a local massage in a non-fixed-point manner.

6 Claims, 15 Drawing Sheets

MOVABLE MASSAGE DEVICE

BACKGROUND OF THE INVENTION

1. Field of the Invention

The present invention relates to a massage device and more particularly, to a movable massage device.

2. Description of the Prior Art

Nowadays, people usually use massage devices to release mental and physical pressure and to relieve muscle stress. As shown in FIG. 1, a conventional massage device essentially comprises a base 11, a motor 12, a worm 13, two worm gears 14, two massage balls 15 and a cover 16. The worm 13 at the end of the motor 12 drives the two worm gears 14 to rotate, and the two massage balls 15 are mounted on the axial shafts of the worm gears 14 in a slantwise manner, so that the massage balls 15 can rotate slantwise to perform a massage.

However, the massage balls 15 can only rotate in a fixed position but are unable to move. Therefore, the massage is carried out in a fixed point mode.

The present invention has arisen to mitigate and/or obviate the afore-described disadvantages.

SUMMARY OF THE INVENTION

The primary object of the present invention is to provide a movable massage device, which is capable of performing a local massage in a movable manner.

To achieve the above object, a movable massage device in accordance with the present invention comprises: an outer housing, a toothed bar, an inner housing, a driven assembly, a drive assembly, a first massage head, and a second massage head. The outer housing is formed with a first chamber, and in the first chamber is an opening connected to outside. The toothed bar is fixed to a bottom of the first chamber by screws and formed around a periphery thereof with teeth. The inner housing is provided with a protrusion which is restricted in and moves along the guiding groove and further provided with a second chamber, and at a bottom of the second chamber is formed an arc-shaped hole to connect outside. The driven assembly includes a driven rod which is to be inserted in and moves along the arc-shaped hole, a first driven toothed wheel fixed at one end of the driven rod and located in the second chamber, and a second driven toothed wheel fixed at another end of the driven rod and engaged with the teeth of the toothed bar. The drive assembly is disposed in the second chamber and includes a motor, a first driven shaft extending out of the inner housing from the second chamber and driven by the motor, a second driven shaft extending out of the inner housing from the second chamber and driven by the motor, and a drive toothed wheel engaged with the first driven toothed wheel and driven by the motor. The first massage head is mounted on the first driven shaft and extends out of the opening of the outer housing. The second massage head is mounted on the second driven shaft and extends out of the opening of the outer housing.

DETAILED DESCRIPTION OF THE PREFERRED EMBODIMENTS

Figure 1:
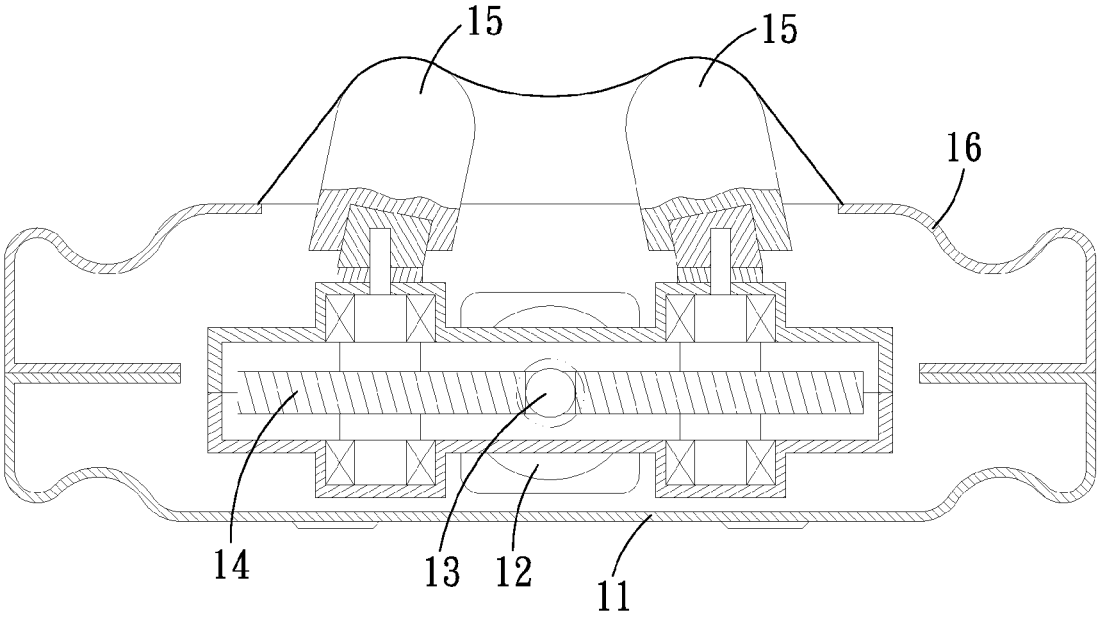
FIG. 1 PRIOR ART
FIG. 1 is a cross sectional view of a conventional massage device.
Figure 2:
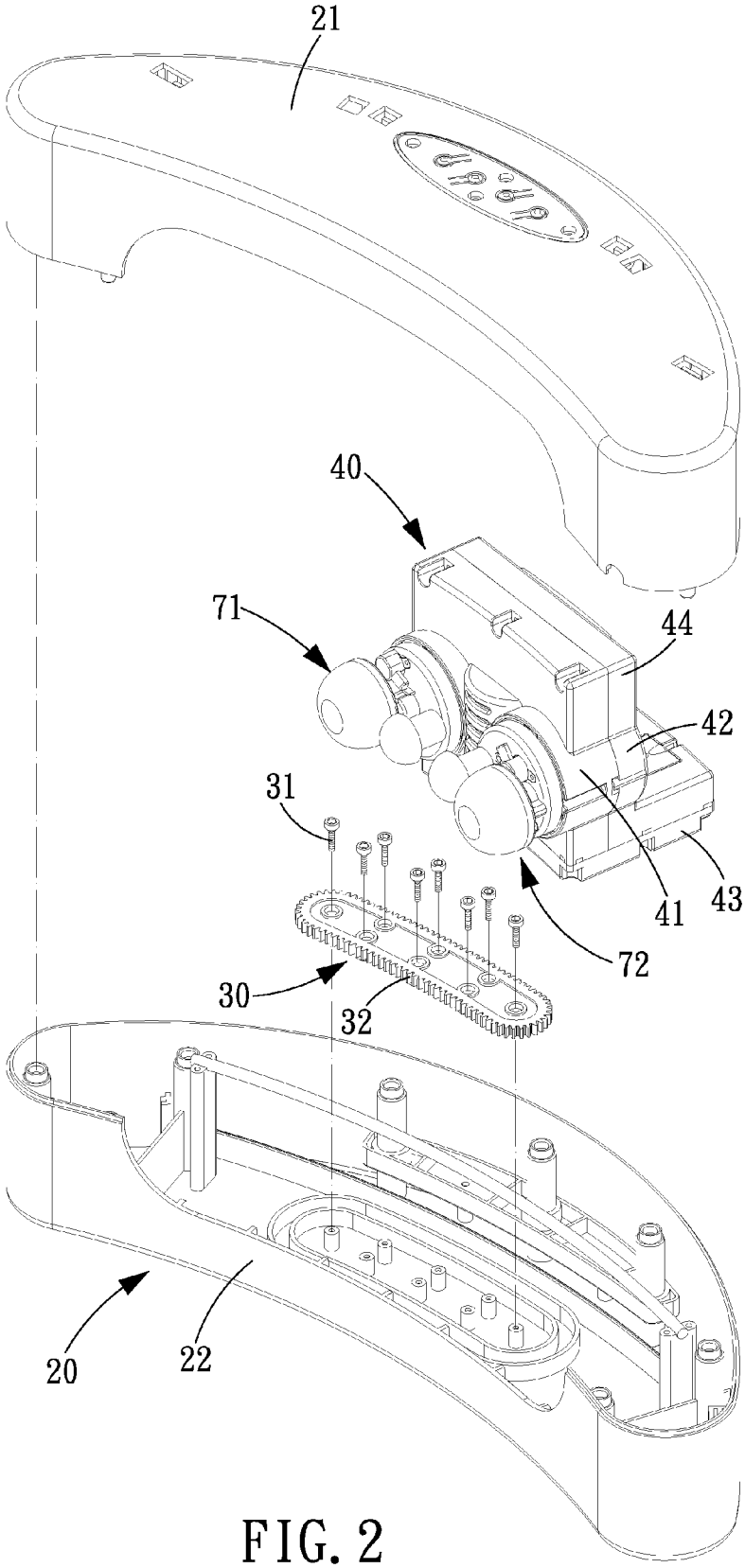
FIG. 2 is an exploded view of a movable massage device in accordance with the present invention.
Figure 3:
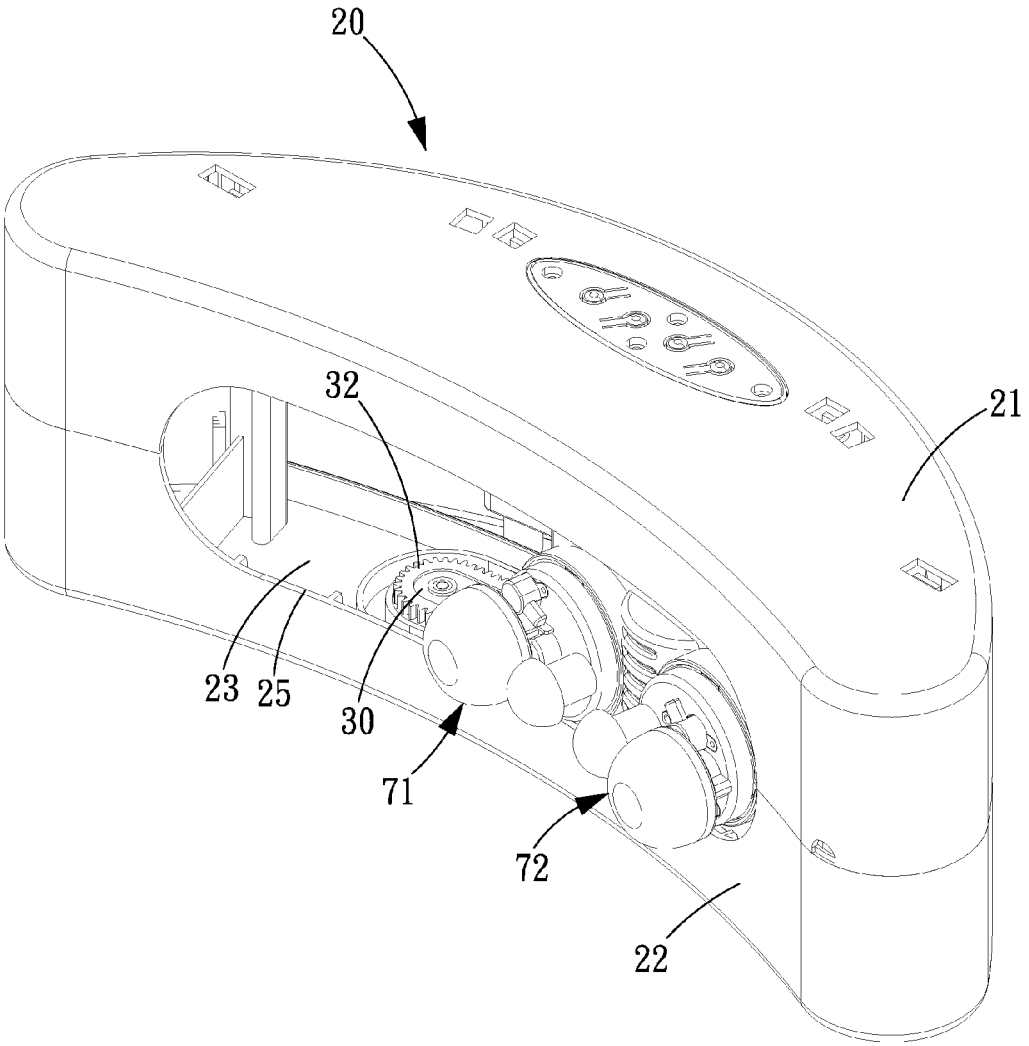
FIG. 3 is an assembly view of the movable massage device in accordance with the present invention.

The present invention will be clearer from the following description when viewed together with the accompanying drawings, which show, for purpose of illustration only, the preferred embodiments in accordance with the present invention.

Referring to FIGS. 2-7, a movable massage device in accordance with the present invention comprises: an outer housing 20, a toothed bar 30, an inner housing 40, a driven assembly 50, a drive assembly 60, a first massage head 71, and a second massage head 72.

The outer housing 20 includes an upper cover 21 and a lower cover 22 which are assembled to together to form the outer housing 20 and is formed with a first chamber 23. In the first chamber 23 are formed a guiding groove 24 located at the top of the first chamber 23 and an opening 25 connected to outside.

The toothed bar 30 is fixed to the bottom of the first chamber 23 by screws 31 and is formed with teeth 32 annularly formed around the periphery of the toothed bar 30.

The inner housing 40 includes a front cover 41, a rear cover 42 and a bottom cover 43 assembled together. The inner housing 40 is provided with a protrusion 44 which is restricted in and moves along the guiding groove 24. The inner housing 40 is further provided with a second chamber 45, and in the second chamber 45 is formed an arc-shaped hole 46 located at the bottom cover 43 to connect outside.

The driven assembly 50 includes a driven rod 51 which is to be inserted in and moves along the arc-shaped hole 46, a first driven toothed wheel 52 fixed at one end of the driven rod 51 and located in the second chamber 45, and a second driven toothed wheel 53 fixed at another end of the driven rod 51 and engaged with the teeth 32 of the toothed bar 30.

Figure 5:
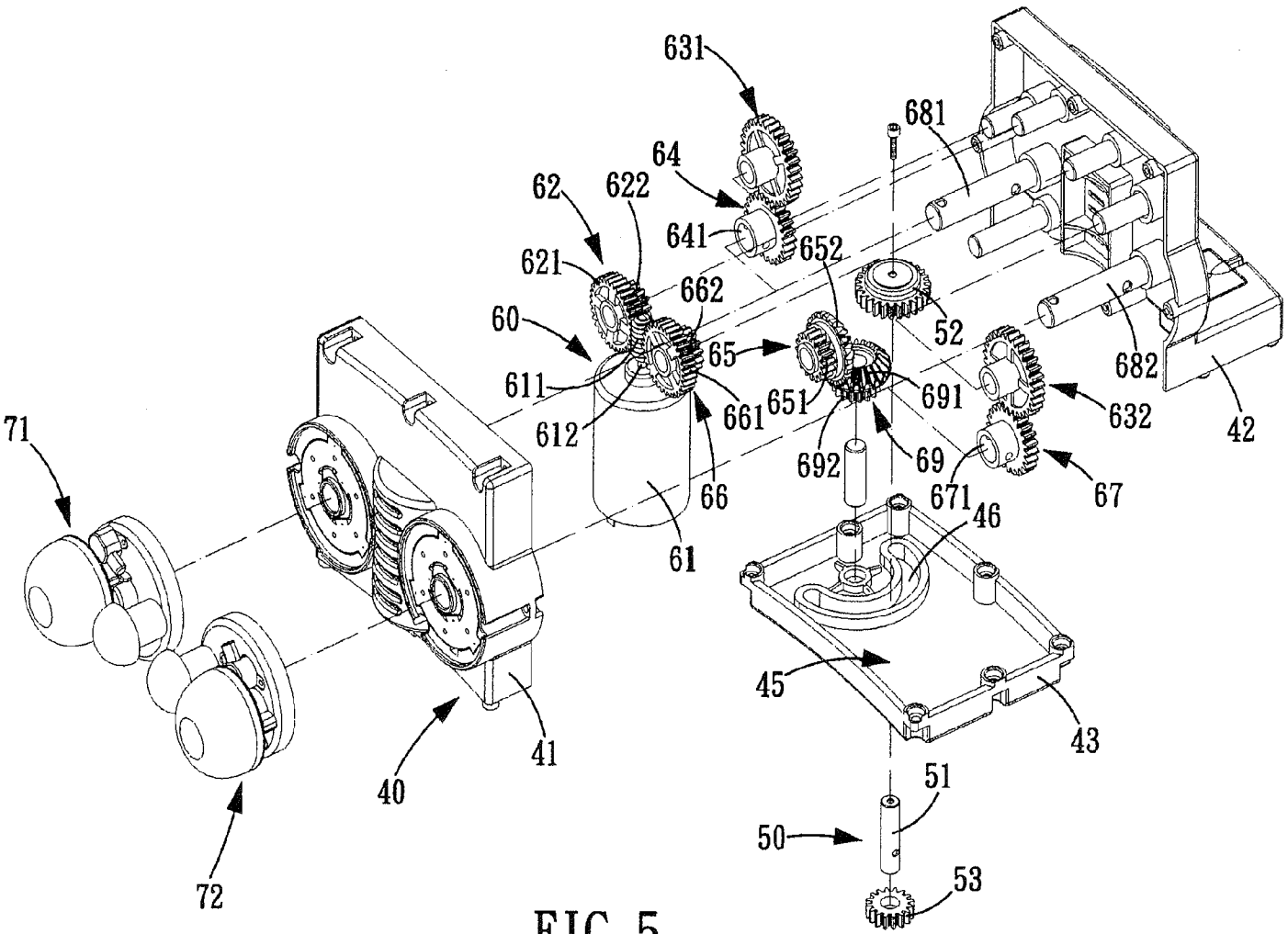
FIG. 5 is another exploded view of the movable massage device in accordance with the present invention.
Figure 6:
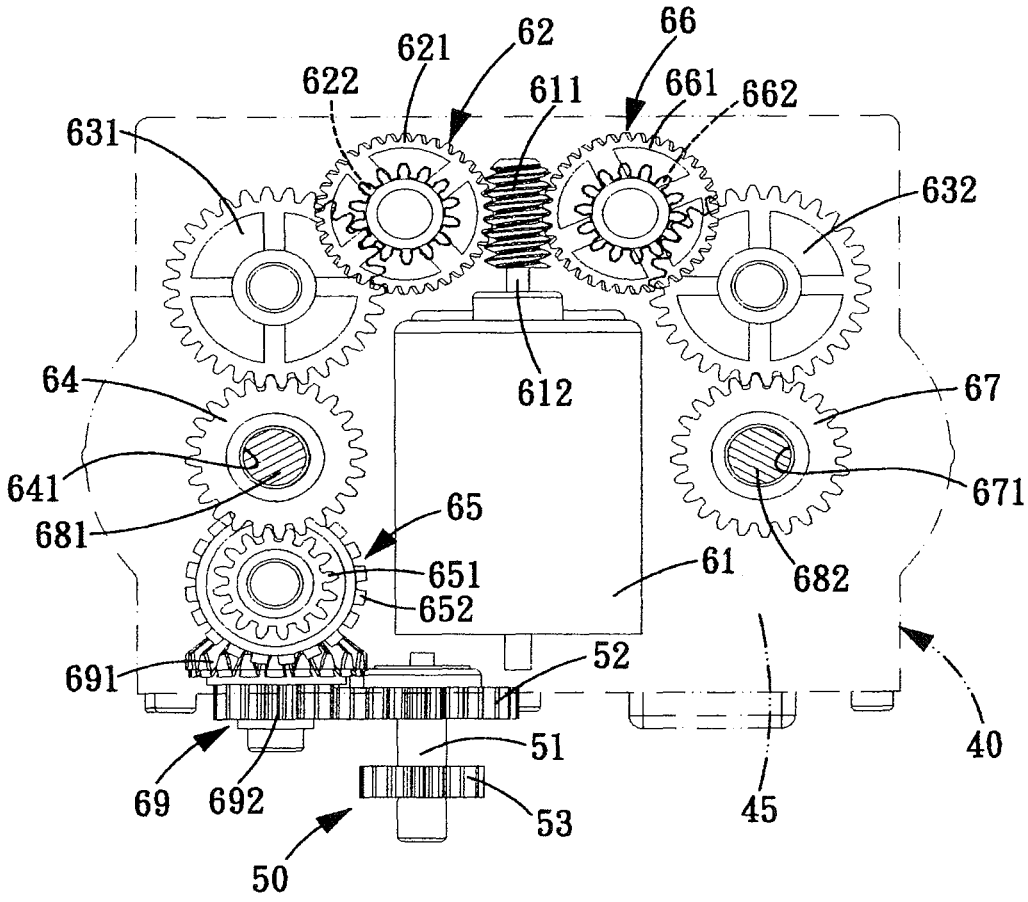
FIG. 6 is a cross sectional view in accordance with the present invention showing the engagement of the driven assembly and the drive assembly.
Figure 7:
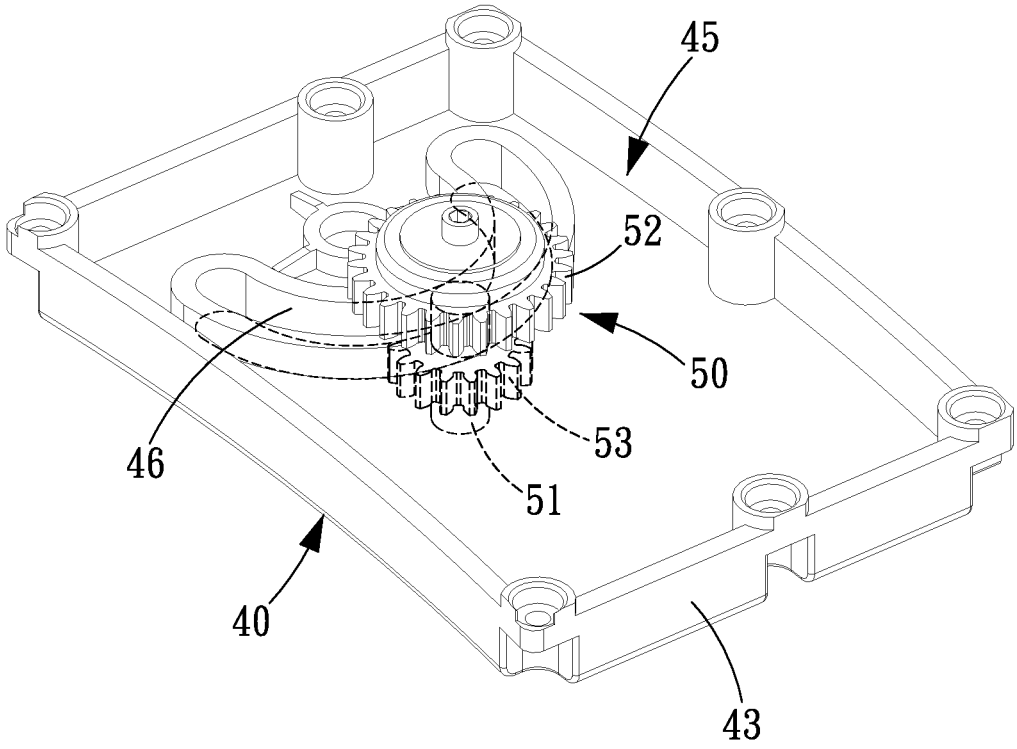
FIG. 7 is a perspective view in accordance with the present invention showing the driven assembly mounted on the outer housing.

Referring to FIGS. 5 and 6, the drive assembly 60 is disposed in the second chamber 45 and includes a motor 61, a first front toothed wheel 62, a first rear toothed wheel 631, a first toothed wheel 64, a steering wheel 65, a second front toothed wheel 66, a second rear toothed wheel 632, a second toothed wheel 67, a first driven shaft 681, a second driven shaft 682, and a drive toothed wheel 69 engaged with the first driven toothed wheel 52.

The motor 61 includes a rotary shaft 612 which is provided with a toothed ring 611.

The first front toothed wheel 62 is rotatably disposed beside the rotary shaft 612 and provided with a first big toothed portion 621 to be engaged with the toothed ring 611, and a first small toothed portion 622 rotatable in the same direction as the first big toothed portion 621.

The first rear toothed wheel 631 is rotatably disposed beside the first front toothed wheel 62 and engaged with the first small toothed portion 622.

The first toothed wheel 64 is engaged with the first rear toothed wheel 631 and formed with a first through hole 641.

The steering wheel 65 includes a toothed portion 651 to be engaged with the first toothed wheel 64 and a steering toothed portion 652 which is engaged with drive toothed wheel 69 and rotates in the same direction as the toothed portion 651.

The second front toothed wheel 66 is rotatably disposed beside the rotary shaft 612 and provided with a second big toothed portion 661 to be engaged with the toothed ring 611, and a second small toothed portion 662 rotating in the same direction as the second big toothed portion 661.

The second rear toothed wheel 632 is rotatably disposed beside the second front toothed wheel 66 and engaged with the second small toothed portion 662.

The second toothed wheel 67 is engaged with the second rear toothed wheel 632 and formed with a second through hole 671.

The first driven shaft 681 is inserted in the first through hole 641 of the first toothed wheel 64 and extends out of the inner housing 40 via the second chamber 45.

The second driven shaft 682 is inserted in the second through hole 671 of the second toothed wheel 67 and extends out of the inner housing 40 via the second chamber 45.

The drive toothed wheel 69 includes a first drive toothed portion 691 engaged with the steering toothed portion 652 of the steering wheel 65, and a second drive toothed portion 692 which rotates in the same direction as the first drive toothed portion 691 and is engaged with the first driven toothed wheel 52 of the driven assembly 50.

The first massage head 71 is mounted on the first driven shaft 681 that extends out of the inner housing 40 and extends out of the opening 25 of the outer housing 20.

The second massage head 72 is mounted on the second driven shaft 682 and extends out of the opening 25 of the outer housing 20.

When the motor 61 of the drive assembly 60 rotates, the interconnected first front and rear toothed wheels 62, 631, the second front and rear toothed wheels 66, 632, the first and second toothed wheels 64, 67, and the first and second driven shafts 681, 682 will make the first and second massage heads 71, 72 rotate along with the first and second driven shafts 681, 682, to perform a massage operation. On top of that, the motor 61 will indirectly drive the drive toothed wheel 69 to rotate, consequently driving the driven assembly 50 to move. Then, the driven assembly 50 drives the inner housing 40 to transversely reciprocate along the guiding groove 24 inside the outer housing 20, to provide a non-fixed-point and local massage.

As for how the inner housing 40 drives the first and second massage heads 71, 72 to move repeatedly in the outer housing 20, after the drive toothed wheel 69 of the drive assembly 60 drives the driven assembly 50 to move, please refer to the following description.

Figure 8A:
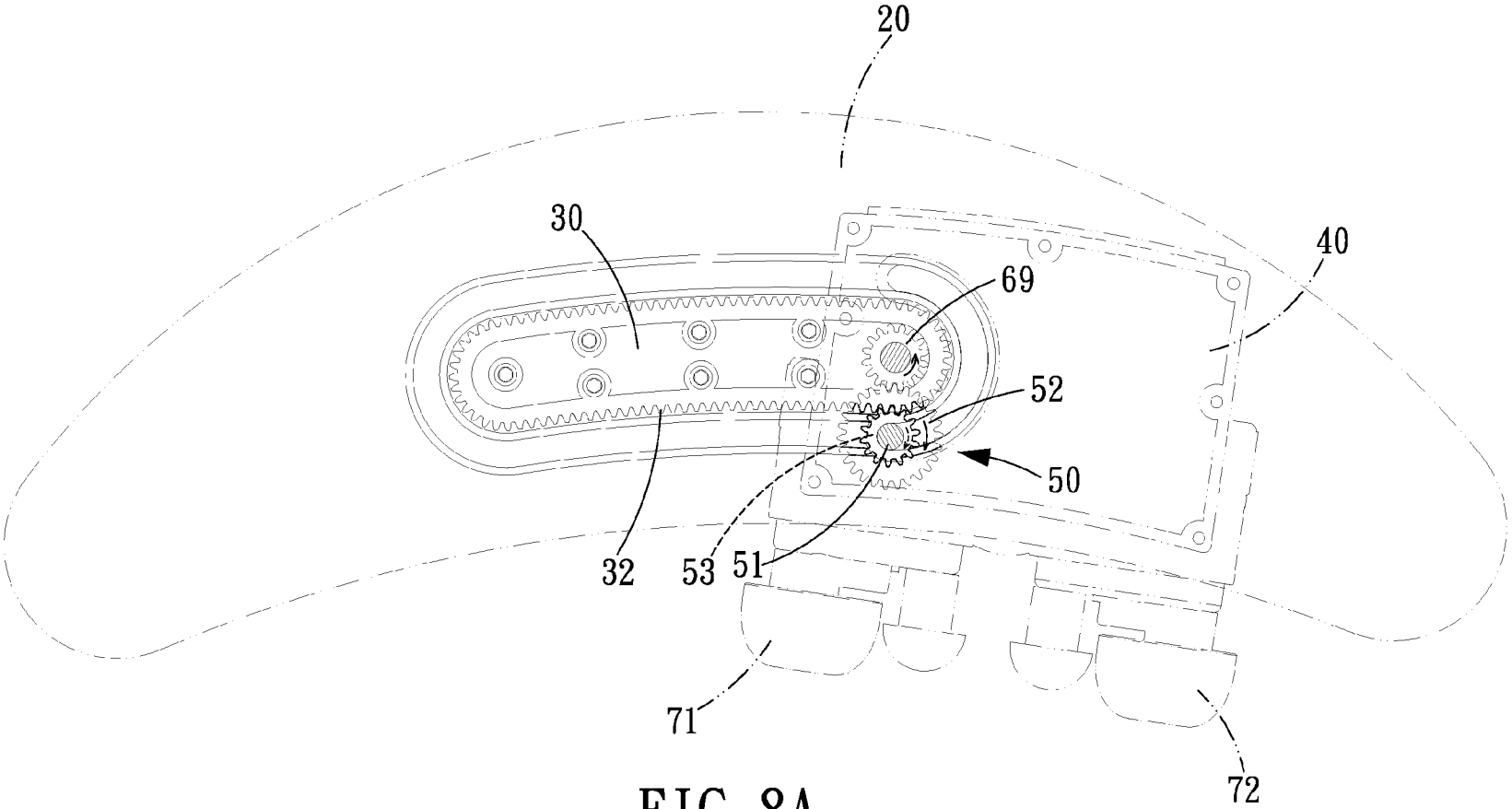
FIG. 8A is a first operational view of the present invention showing the state before the driven assembly drives the inner housing to move along the toothed bar towards the left side of the outer housing.
Figure 8B:
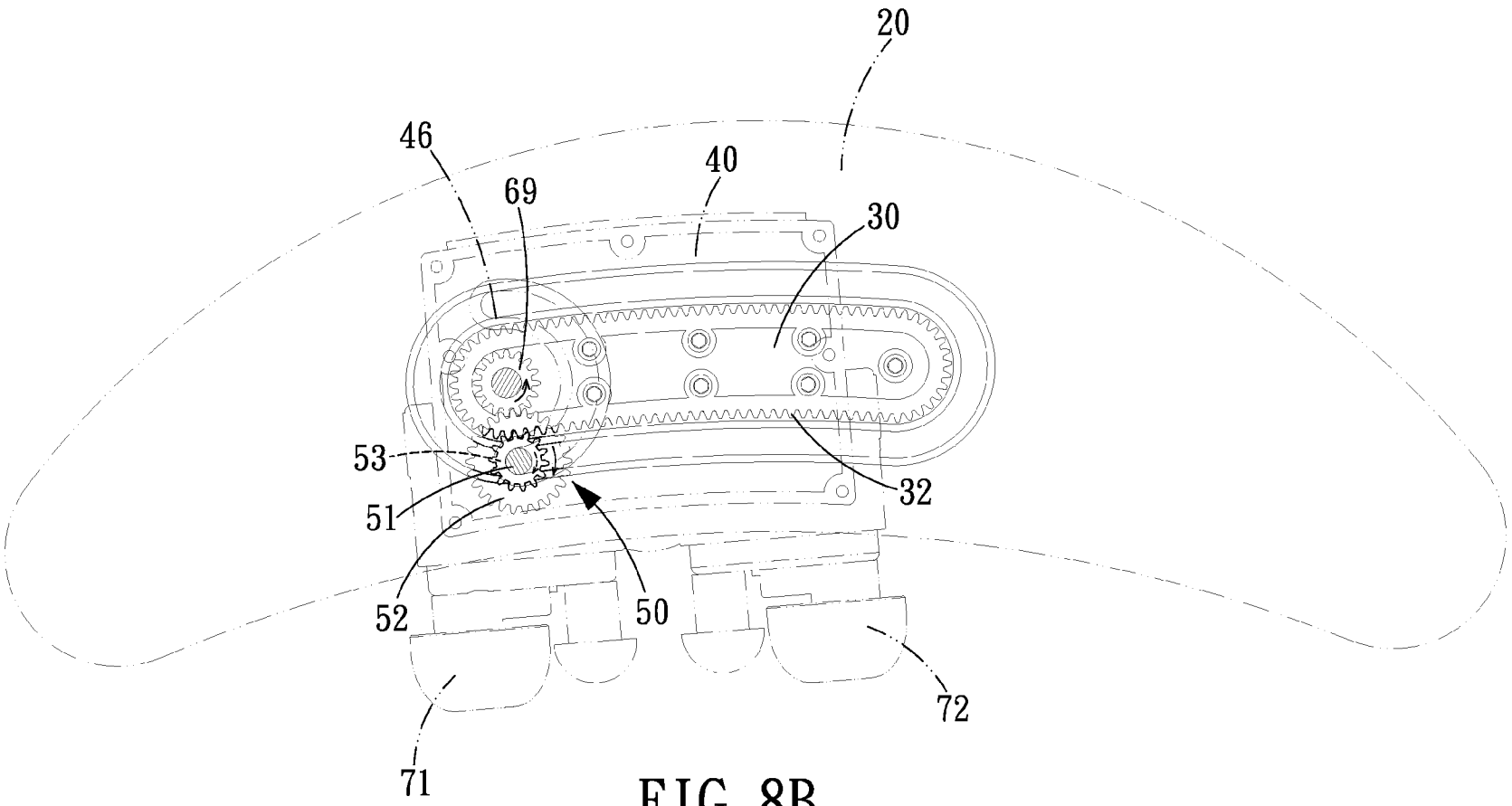
FIG. 8B is a second operational view of the present invention showing the state after the driven assembly drives the inner housing to move along the toothed bar towards the left side of the outer housing.

As shown in FIGS. 8A and 8B, when the drive toothed wheel 69 which rotates counterclockwise and drives the first driven toothed wheel 52 of the driven assembly 50 to rotate, the first driven toothed wheel 52 will rotate in a clockwise direction, and the first driven toothed wheel 52 will drive the second driven toothed wheel 53 to rotate clockwise by the driven rod 51. At this moment, since the inner housing 40 is restricted in the guiding groove 24 (as shown in FIG. 4) of the outer housing 20, and since the motion of the second driven toothed wheel 53 along the teeth 32 of the toothed bar 30 is a transverse linear motion towards the left, the inner housing 40 will move toward the left side of the outer housing 20 along with the engagement of the second driven toothed wheel 53 with the teeth 32 of the toothed bar 30.

Figure 4:
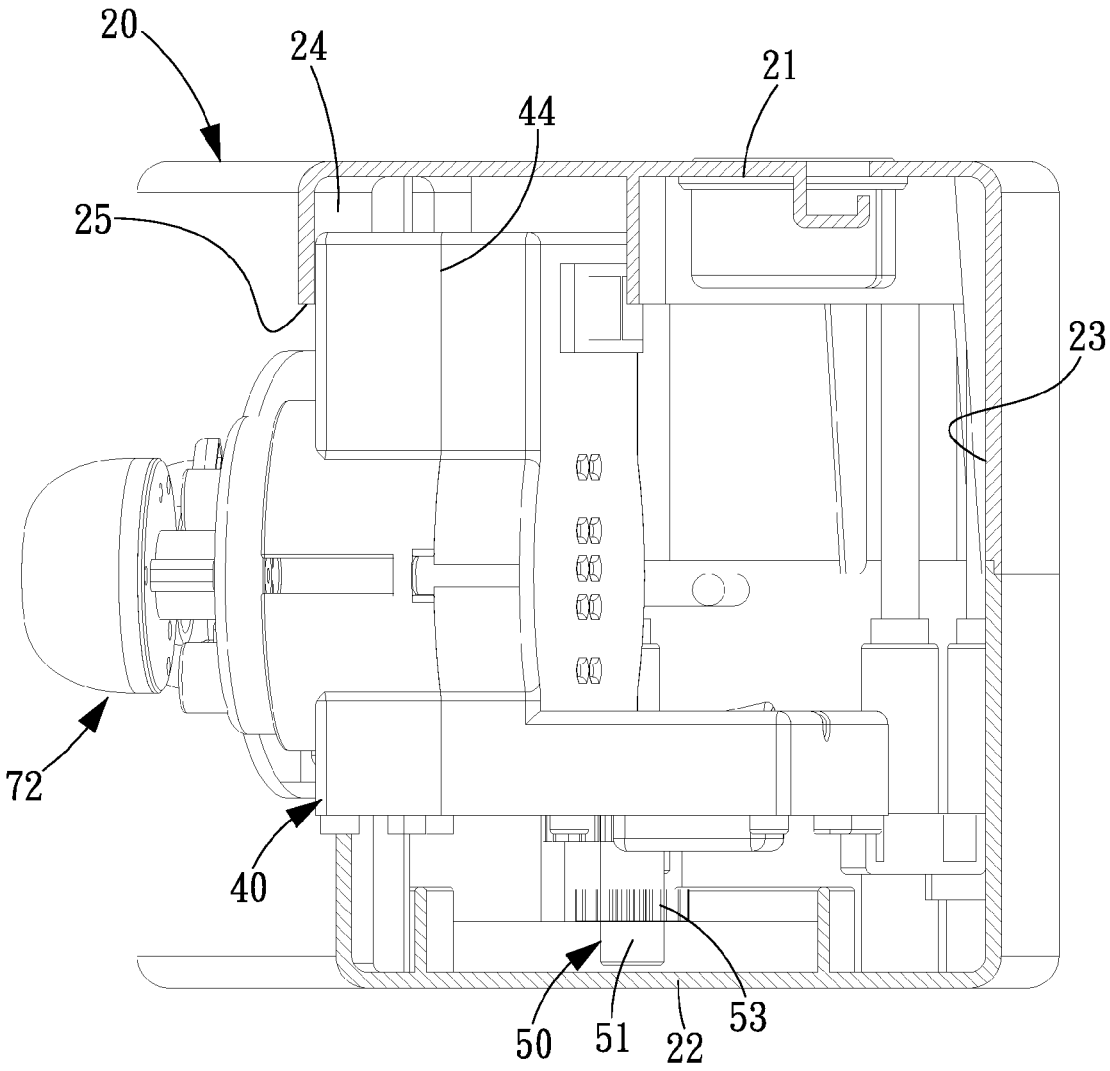
FIG. 4 is a cross sectional view in accordance with the present invention showing the inner housing restricted in the guiding groove of the outer housing.
Figure 8C:
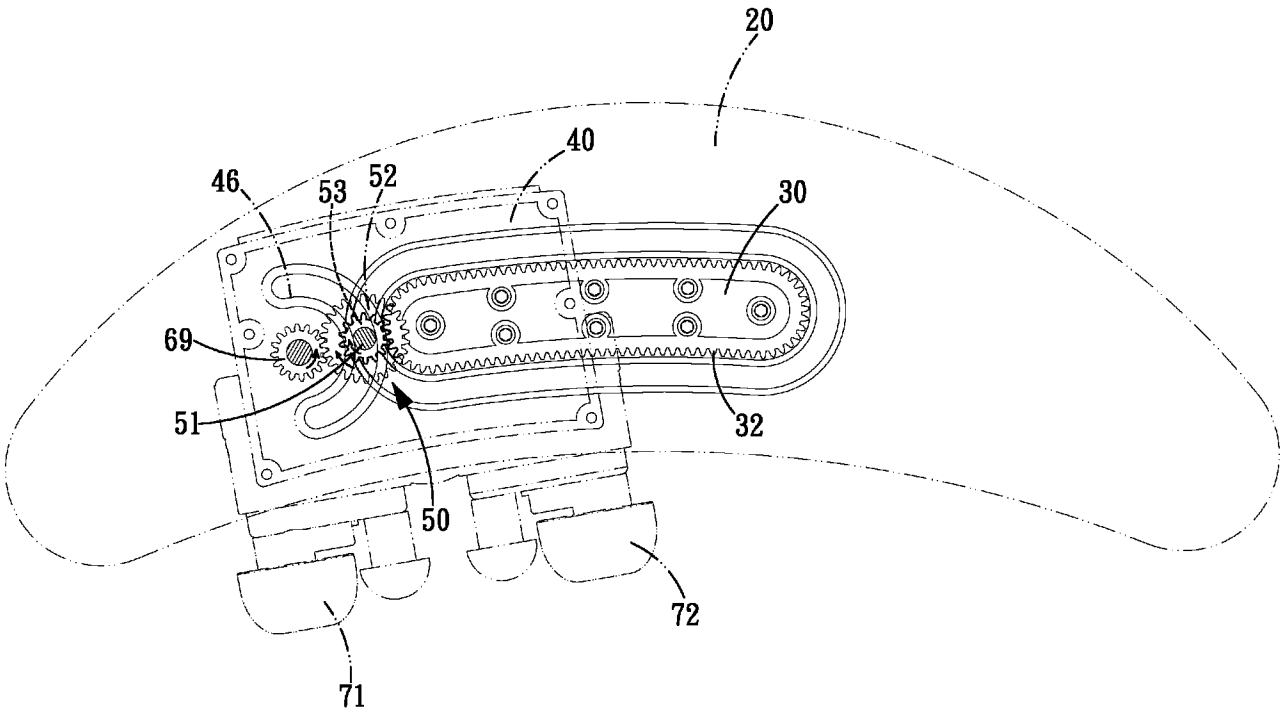
FIG. 8C is a third operational view of the present invention showing the state when the driven assembly is driving the inner housing to move along the toothed bar towards the rear side of the outer housing.
Figure 8D:
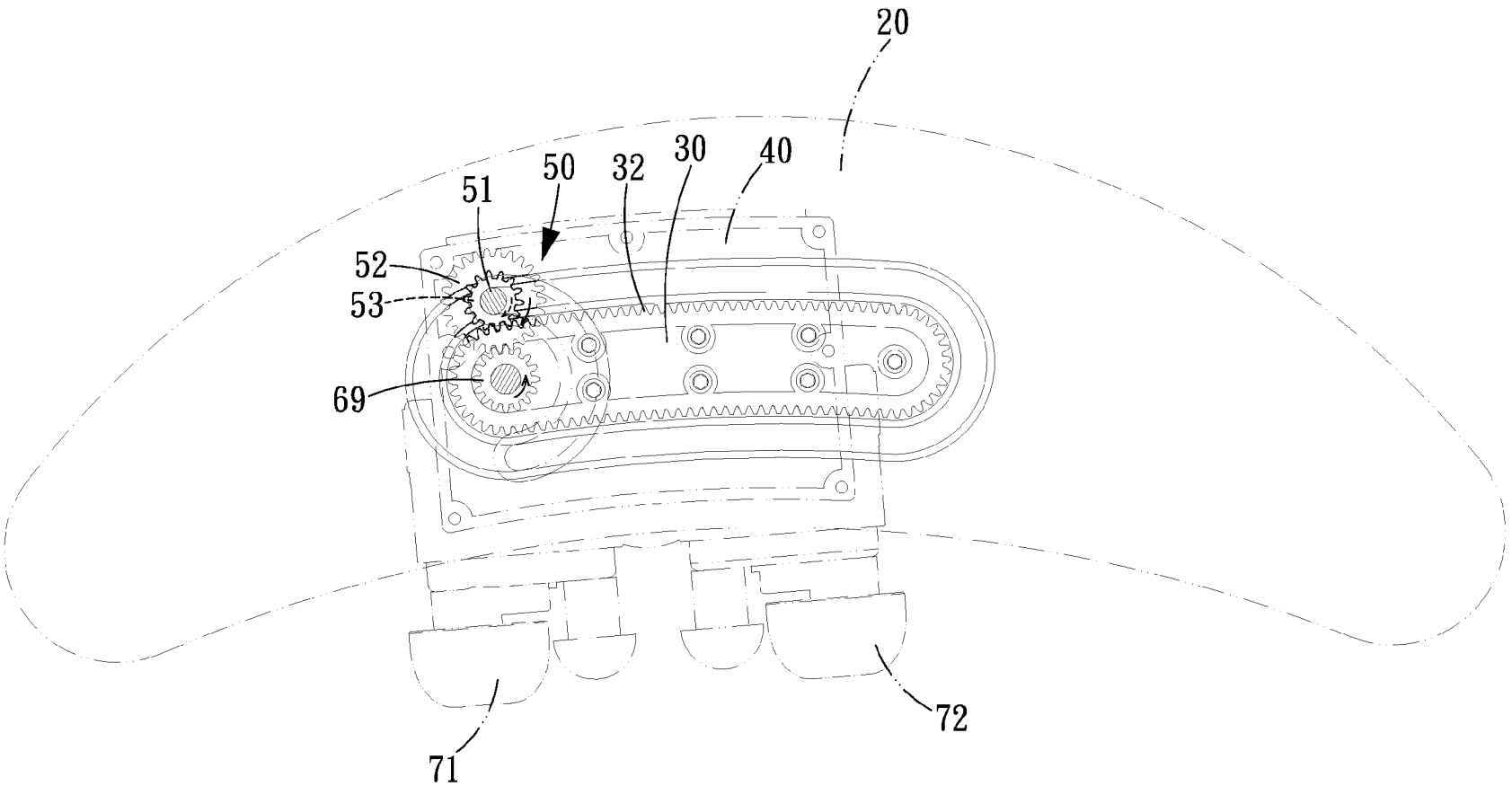
FIG. 8D is a fourth operational view of the present invention showing the state after the driven assembly drives the inner housing to move along the toothed bar towards the rear side of the outer housing.

Referring to FIGS. 8B and 8C, when the driven assembly 50 drives the inner housing 40 to move to the left side of the outer housing 20, and when the second driven toothed wheel 53 moves backwards along the path of the teeth 32 of the toothed bar 30 (the inner housing 40 won't move backwards since it is restricted in the guiding groove 24 of the outer housing 20 as shown in FIG. 4), the driven rod 51 of the driven assembly 50 will be driven to move along the arc-shaped hole 46 of the inner housing 40 until the second driven toothed wheel 53 is located in the transverse path of the toothed bar 30, as shown in FIG. 8D.

Figure 8E:
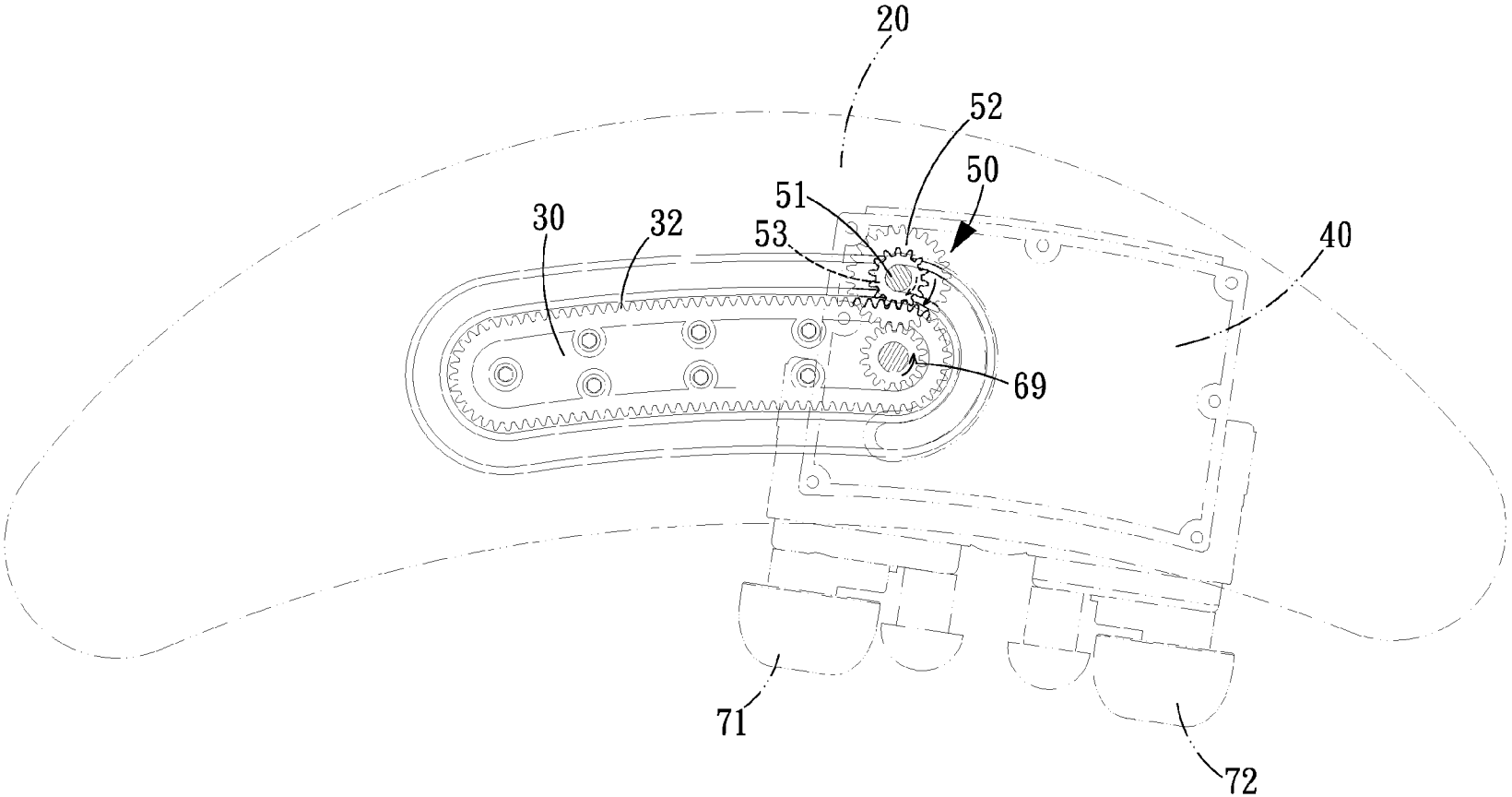
FIG. 8E is a fifth operational view of the present invention showing the state before the driven assembly drives the inner housing to move along the toothed bar towards the right side of the outer housing.

Referring to FIGS. 8D and 8E, when the drive toothed wheel 69 which continuously rotates counterclockwise and drives the first driven toothed wheel 52 of the driven assembly 50 to rotate, since the inner housing 40 is restricted in the guiding groove 24 of the outer housing 20, and since the motion of the second driven toothed wheel 53 along the teeth 32 of the toothed bar 30 is a transverse linear motion towards the right, the inner housing 40 will move towards the right side of the outer housing 20 along with the engagement of the second driven toothed wheel 53 with the teeth 32 of the toothed bar 30.

Figure 8F:
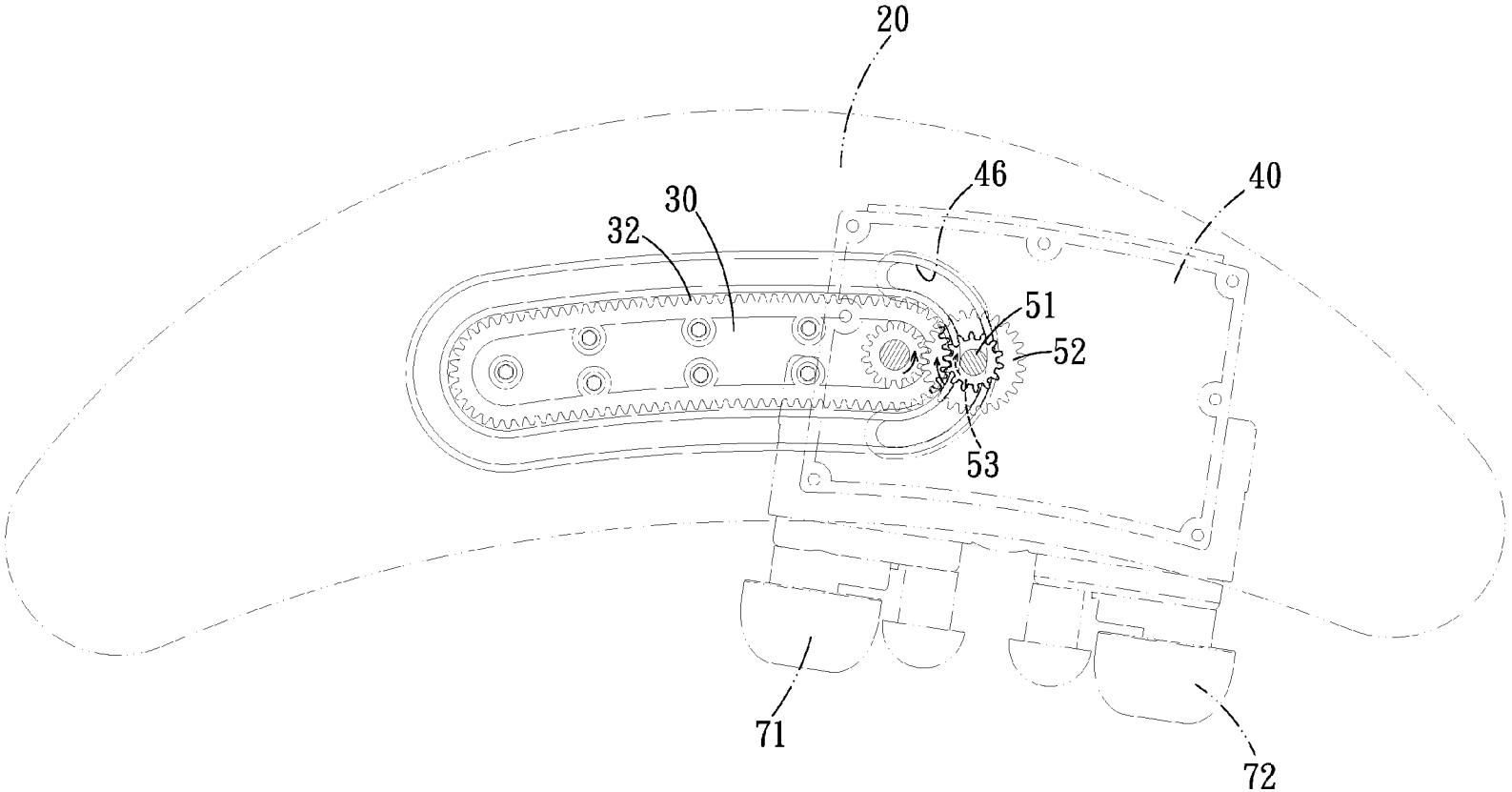
FIG. 8F is a sixth operational view of the present invention showing the state when the driven assembly is driving the inner housing to move along the toothed bar towards the front side of the outer housing.

Referring to FIGS. 8E and 8F, when the driven assembly 50 drives the inner housing 40 to move to the right side of the outer housing 20, and since the second driven toothed wheel 53 moves forward along the path of the teeth 32 of the toothed bar 30, (the inner housing 40 won't move forward since it is restricted in the guiding groove 24 of the outer housing 20), the driven rod 51 of the driven assembly 50 will be moved along the arc-shaped hole 46 of the inner housing 40 until the second driven toothed wheel 53 is located in the transverse path of the toothed bar 30, as shown in FIG. 8A.

Hence, the inner housing 40 is able to drive the first and second massage heads 71, 72 to reciprocate within the outer housing 20, to perform a local massage while solving the disadvantage of the conventional fixed-point massage.

Figure 9:
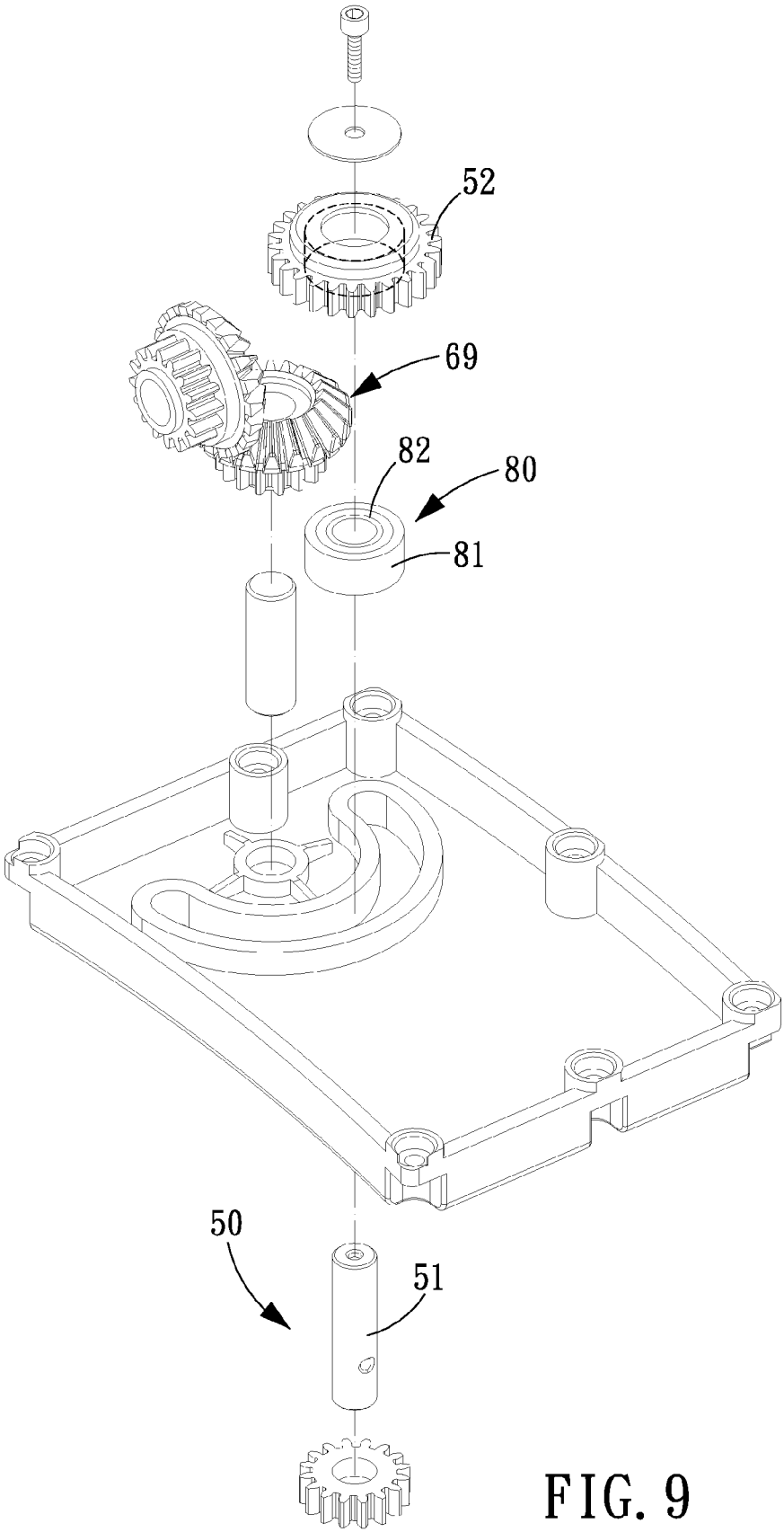
FIG. 9 is another exploded view of a movable massage device in accordance with another embodiment of the present invention.
Figure 10:
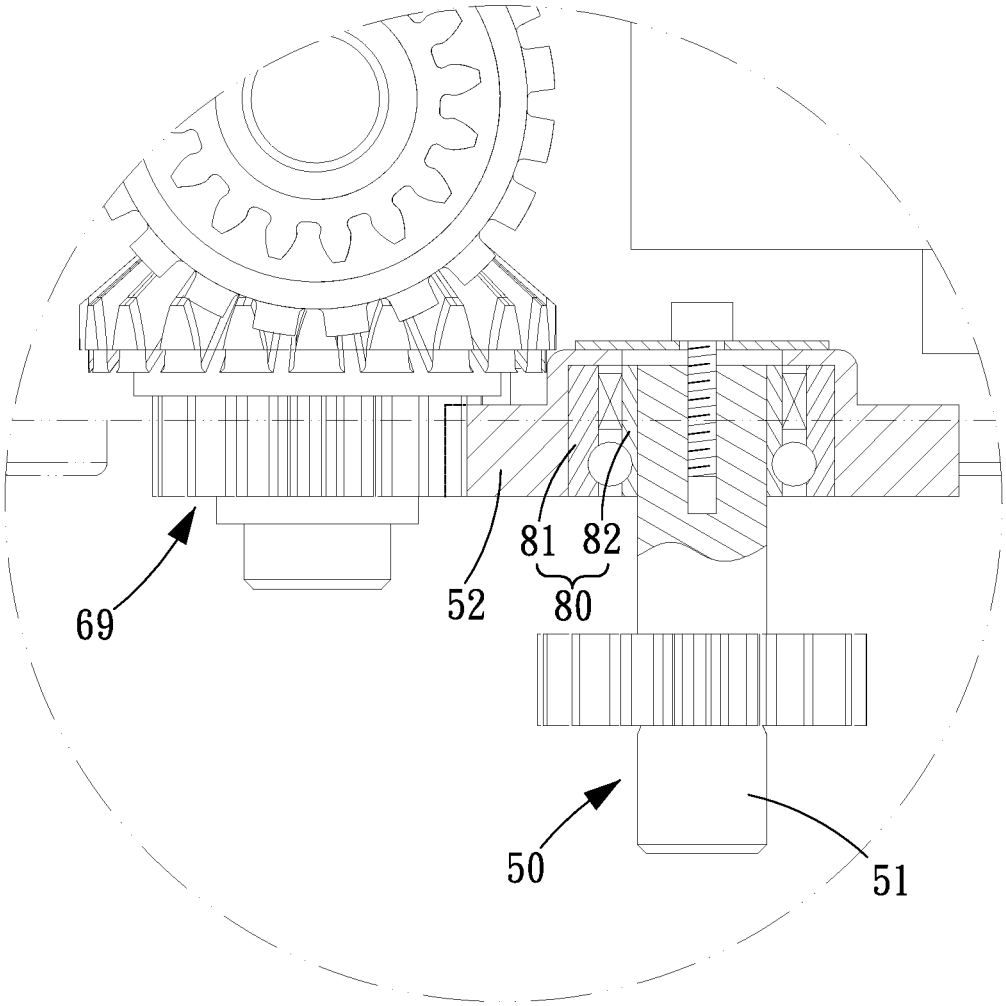
FIG. 10 is an enlarged view of a part of the movable massage device in accordance with another embodiment of the present invention.

Referring to FIGS. 6, 9 and 10, the present invention is further provided between the driven rod 51 and the first driven toothed wheel 52 of the driven assembly 50 with a one-way bearing 80 which includes an outer ring 81 inserted in the first driven toothed wheel 52 and an inner ring 82 mounted on the driven rod 51, and the inner ring 82 rotates idly in an opposite direction to the rotation direction of the outer ring 81, so that the first driven toothed wheel 52 can only be rotated in a unidirectional manner by the drive toothed wheel 69. Hence, when the motor 61 of the drive assembly 60 rotates clockwise, the inner housing 40 can be driven to move transversely within the outer housing 20, to provide a non-fixed-point massage. When the motor 61 rotates counterclockwise, the one-way bearing 80 will make the drive toothed wheel 69 stop driving the driven assembly 50, and, consequently, the inner housing 40 stops moving. At this moment, however, the motor 61 still drives the first and second massage head 71, 72 (not shown) to move by using the engagement of the respective toothed wheels, to perform a massage in a fixed-point manner.

While various embodiments in accordance with the present invention have been shown and described, it is clear to those skilled in the art that further embodiments may be made without departing from the scope of the present invention.

What is claimed is:

1. A movable massage device comprising:

an outer housing formed with a first chamber, and in the first chamber being formed an opening connected to outside;

a toothed bar fixed to a bottom of the first chamber by screws and formed around a periphery thereof with teeth;

an inner housing provided with a protrusion which is restricted in and moves along a guiding groove and further provided with a second chamber, and at a bottom of the second chamber being formed an arc-shaped hole to connect outside;

a driven assembly including a driven rod which is to be inserted in and moves along the arc-shaped hole, with a first driven toothed wheel fixed at one end of the driven rod and located in the second chamber, and with a second driven toothed wheel fixed at another end of the driven rod and engaged with the teeth of the toothed bar;

a drive assembly disposed in the second chamber and including a motor, with a first driven shaft extending out of the inner housing from the second chamber and driven by the motor, with a second driven shaft extending out of the inner housing from the second chamber and driven by the motor, and with a drive toothed wheel engaged with the first driven toothed wheel and driven by the motor;

a first massage head mounted on the first driven shaft and extending out of the opening of the outer housing; and a second massage head mounted on the second driven shaft and extending out of the opening of the outer housing.

2. The movable massage device as claimed in claim 1, wherein the outer housing includes an upper cover and a lower cover which are assembled together to form the first chamber.

3. The movable massage device as claimed in claim 1, wherein the inner housing includes a front cover, a rear cover and a bottom cover assembled together to form the second chamber, and wherein the arc-shaped hole is formed in the bottom cover.

4. The movable massage device as claimed in claim 1, wherein the drive assembly further includes a first front toothed wheel, a first rear toothed wheel, a first toothed wheel, a steering wheel, a second front toothed wheel, a second rear toothed wheel, and a second toothed wheel, wherein the motor includes a rotary shaft which is provided with a toothed ring, wherein the first front toothed wheel is rotatably disposed beside the rotary shaft and provided with a first big toothed portion to be engaged with the toothed ring, with a first small toothed portion rotatable in the same direction as the first big toothed portion, wherein the first rear toothed wheel is rotatably disposed beside the first front toothed wheel and engaged with the first small toothed portion, wherein the first toothed wheel is engaged with the first rear toothed wheel and formed with a first through hole for insertion of the first driven shaft, wherein the steering wheel includes a toothed portion to be engaged with the first toothed wheel and a steering toothed portion which is engaged with the drive toothed wheel and rotates in the same direction as the toothed portion, wherein the second front toothed wheel is rotatably disposed beside the rotary shaft and provided with a second big toothed portion to be engaged with the toothed ring, with a second small toothed portion rotating in the same direction as the second big toothed portion, wherein the second rear toothed wheel is rotatably disposed beside the second front toothed wheel and engaged with the second small toothed portion, and wherein the second toothed wheel is engaged with the second rear toothed wheel and formed with a second through hole for insertion of the second driven shaft.

5. The movable massage device as claimed in claim 4, wherein the drive toothed wheel includes a first drive toothed portion engaged with the steering toothed portion of the steering wheel, and wherein a second drive toothed portion which rotates in the same direction as the first drive toothed portion is engaged with the first driven toothed wheel of the driven assembly.

6. The movable massage device as claimed in claim 1, wherein a one-way bearing is disposed between the driven rod and the first driven toothed wheel of the driven assembly.

* * * * *